US006576879B1

(12) United States Patent
Hoh

(10) Patent No.: US 6,576,879 B1
(45) Date of Patent: Jun. 10, 2003

(54) MICROWAVE OVEN WITH WAVE DISTRIBUTING DEVICE

(75) Inventor: Jung-Eui Hoh, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/189,394

(22) Filed: Jul. 8, 2002

(30) Foreign Application Priority Data

Nov. 27, 2001 (KR) ..... 2001-74292

(51) Int. Cl.[7] ..... H05B 6/72; H05B 6/74
(52) U.S. Cl. ..... 219/749; 219/751
(58) Field of Search ..... 219/749, 751, 219/748, 746, 747, 745

(56) References Cited

U.S. PATENT DOCUMENTS 3,366,769 A * 1/1968 Lima ..... 219/751
4,144,436 A 3/1979 Hauck ..... 219/751
4,714,811 A * 12/1987 Gerling et al. ..... 219/751
5,998,775 A * 12/1999 Sung ..... 219/751

* cited by examiner

*Primary Examiner*—Philip H. Leung

(57) ABSTRACT

A microwave oven having a wave distributing device. A motor-operated rotor is installed inside a cooking cavity to distribute high-frequency electromagnetic waves ("microwaves") generated by the oscillation of a magnetron. The wave distributing device includes a rotation trace limiter which limits a rotation trace of the rotor within a predetermined range. The rotation trace limiter includes stoppers which limit the rotation of the rotor, or a cam mechanism unit which changes a movement of a motor shaft connecting the rotor to the motor. Accordingly, an optimum energy efficiency is achieved, thereby saving energy required during an operation of the microwave oven under a standard load. In addition, the amount of the microwaves reflected back to the magnetron during an operation under a no-load or a light load is reduced. Therefore, life expectancy of the magnetron and the overall operational reliability of the microwave oven are improved.

22 Claims, 10 Drawing Sheets

MICROWAVE OVEN WITH WAVE DISTRIBUTING DEVICE

CROSS-REFERENCE TO RELATED APPLICATIONS

This application claims the benefit of Korean Application No. 2001-74292, filed Nov. 27, 2001, in the Korean Patent Office, the disclosure of which is incorporated herein by reference.

BACKGROUND OF THE INVENTION

1. Field of the Invention

The present invention relates to a microwave oven having a magnetron which oscillates high-frequency electromagnetic waves and a device which distributes the high-frequency electromagnetic waves through a cooking cavity and, more particularly, to a microwave oven which limits a rotation trace range of a wave distributing device.

2. Description of the Related Art

In general, a microwave oven is an electrically operated oven which radiates high-frequency electromagnetic waves (of about 2450 MHz), generated by the oscillation of a magnetron, through a cooking cavity. In the cooking cavity, the high-frequency electromagnetic waves, so-called "microwaves," penetrate food and cause its molecules to vibrate and generate heat to cook the food. Such a microwave oven is provided with a device which distributes the microwaves through the cooking cavity.

FIG. 1 shows a conventional microwave oven having a wave distributing device. The wave distributing device comprises a metal stirrer fan 4 which is installed at a top portion of an cooking cavity 3 of an oven body 1 and is operated by a motor 5. Generally, the motor 5 is started simultaneously with the start of a magnetron 2, and rotates the stirrer fan 4 to distribute microwaves, which are radiated from the magnetron 2, through the cooking cavity 3 to heat and cook food laid on a cooking tray 6 of the cooking cavity 3.

FIG. 2 shows another conventional microwave oven having a different type of a wave distributing device. The wave distributing device of the microwave oven shown in FIG. 2 comprises a metal antenna 7 which is installed at a top portion of a cooking cavity 3 of an oven body 1 and is operated by a motor 5. Generally, the motor 5 is started simultaneously with the start of a magnetron 2, and rotates the antenna 7 to distribute microwaves generated from the magnetron 5 through the cooking cavity 3.

As described above, the wave distributing devices of conventional microwave ovens either rotate the stirrer fan 4 or the antenna 7 using the motor 5, which is simultaneously started with the start of the magnetron 2, to distribute the microwaves through the cooking cavity 3.

Intrinsic impedance characteristics of microwave ovens are, in part, determined by the types of wave distributing devices used in the microwave ovens. To improve an energy efficiency of the microwave ovens, it is necessary to optimize the impedance characteristics of the microwave ovens. Therefore, an impedance matching must be carried out during a process of designing a microwave oven. That is, impedance characteristics of a microwave oven are measured using, for example, a network analyzer and an antenna probe on Rieke charts to design the microwave oven having the maximum energy efficiency.

FIG. 3 shows a Rieke chart illustrating a distribution of impedance characteristics of a conventional microwave oven. The impedance characteristics were measured under a standard load (water of 1000 cc). In this drawing, it is noted that the impedance of the microwave oven has been matched to obtain the maximum energy efficiency.

However, FIG. 4 shows that even though the conventional microwave oven is designed to match its impedance under the standard load, the impedance characteristics of the microwave oven under a no-load or a light load are distributed differently from the distribution characteristics corresponding to the standard load. That is, FIG. 4 shows that the impedance characteristics of the conventional microwave oven are distributed at an outside area of the Rieke chart. Accordingly, the maximum energy efficiency is not achieved and the life expectancy of the magnetron 2 is reduced. In other words, the magnetron 2 of the conventional microwave ovens are prone to overheating because under a no-load or a light load, the microwaves distributed by the metal stirrer fan 4 or the metal antenna 7 are returned to the magnetron 2 due to a reduction in the amount of load absorbing the microwaves. With the magnetron 2 overheated, operational reliability and safety of the conventional microwave ovens are reduced.

Therefore, there is a need to design a microwave oven having impedance characteristics that are not distributed at an outside area of the Rieke chart even where a magnetron is started under a no-load or a light load. However, it is noted that a distribution of intrinsic impedance characteristics of a microwave oven is difficult to control because the intrinsic impedance characteristics change in accordance with the structure, shape and material of a cooking cavity of the microwave oven.

SUMMARY OF THE INVENTION

In accordance with experiments performed by the inventor of this invention, impedance characteristics of a microwave oven are differentiated in accordance with a rotation trace of a stirrer fan or an antenna. Thus, it is possible to divide the entire range of the rotation trace of the stirrer fan or the antenna into a section resulting in a good distribution of the impedance characteristics, and into another section resulting in a bad distribution of the impedance characteristics. As described above, the intrinsic impedance characteristics of a microwave oven changes in accordance with the structure, shape and material of a cooking cavity. Accordingly, a range of the rotation trace of the stirrer fan or the antenna resulting in a good distribution of the impedance characteristics is changed in accordance with a model of a microwave oven.

Therefore, it is possible to improve the impedance characteristics of a microwave oven because the rotation trace of the stirrer fan or the antenna is limited to a predetermined range on the basis of data obtained during the process of designing the microwave oven. Particularly, such a limited rotation trace desirably improves the impedance characteristics of the microwave oven under a no-load or a light load.

Accordingly, it is an object of the present invention to provide a microwave oven having a wave distributing device which is designed to optimize intrinsic impedance characteristics of the microwave oven, thus improving the energy efficiency and the operational reliability of the microwave oven.

Additional objects and advantages of the invention will be set forth in part in the description which follows, and, in part, will be obvious from the description, or may be learned by practice of the invention.

To achieve the above and other objects of the present invention, there is provided a microwave oven comprising a cooking cavity, a magnetron which generates high-frequency electromagnetic waves, a wave distributing device which distributes the high-frequency electromagnetic waves through the cooking cavity, wherein the wave distributing device comprises a rotor which is installed inside the cooking cavity and distributes the high-frequency electromagnetic waves through the cooking cavity, a rotation trace limiter which limits a rotation trace range of the rotor, and a motor which reversibly rotates the rotor.

According to an aspect of the present invention, the rotation trace limiter comprises a stopper which limits a rotation of the rotor. The stopper may comprise a cylindrical rod, where one end thereof is fixed to a corresponding area of the rotor. The stopper may comprise a core member and an elastic member which covers the core member.

According to another aspect of the present invention, the rotation trace limiter comprises a cam mechanism unit which changes a movement of a motor shaft that connects the rotor to the motor.

According to yet another aspect of the present invention, at least two stoppers are used in the wave distributing device to limit the rotation of the rotor to the rotation trace range.

According to still another aspect of the present invention, the motor is a synchronous motor which is rotated in a forward direction or a reverse direction by an alternating current. The synchronous motor reciprocates the rotor within the rotation trace range. The synchronous motor is rotated in the forward direction to rotate the rotor in one direction, and is rotated in the reverse direction to rotate the rotor in the opposite direction in response to a contact between the rotor rotated in the one direction with the stopper.

The rotation trace range limited by the microwave oven of the present invention provides low intrinsic impedance characteristics as compared to conventional microwave ovens having an unlimited rotation trace range which results in poor impedance characteristics.

BRIEF DESCRIPTION OF THE DRAWINGS

The above and other objects, features and advantages of the present invention will become more apparent and more readily appreciated by describing in detail preferred embodiments thereof with reference to the accompanying drawings in which.

DETAILED DESCRIPTION OF THE PREFERRED EMBODIMENTS

Figure 1:
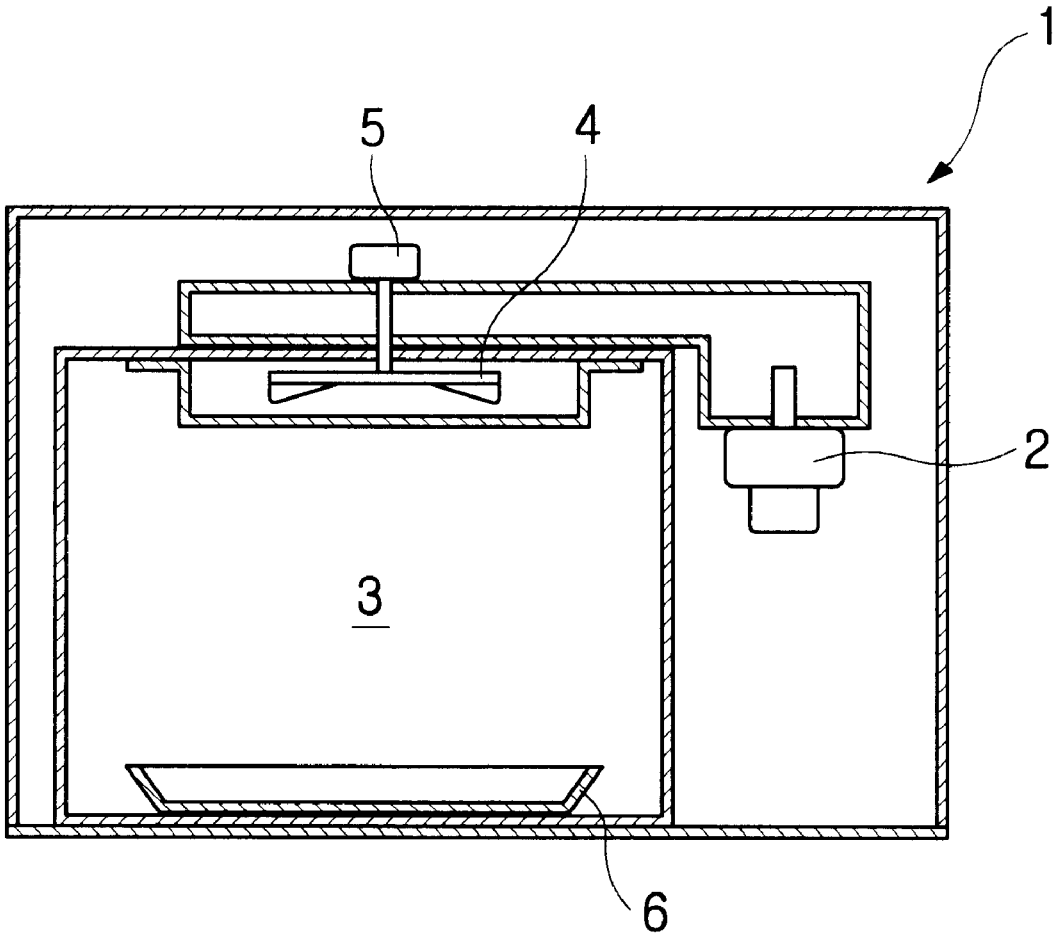
FIG. 1 (PRIOR ART)
FIG. 1 is a sectional view of a conventional microwave oven with a wave distributing device having a motored stirrer fan.
Figure 2:
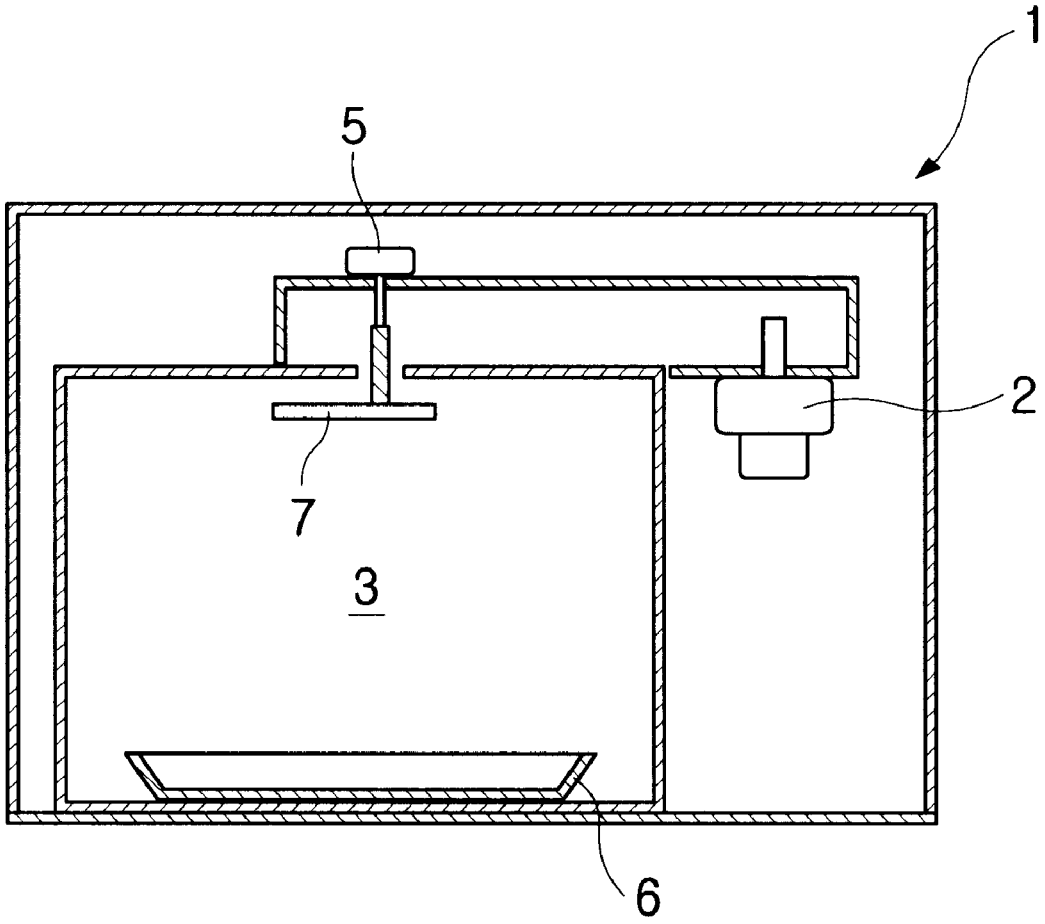
FIG. 2 (PRIOR ART)
FIG. 2 is a sectional view of a conventional microwave oven with another wave distributing device having a motored antenna.
Figure 3:
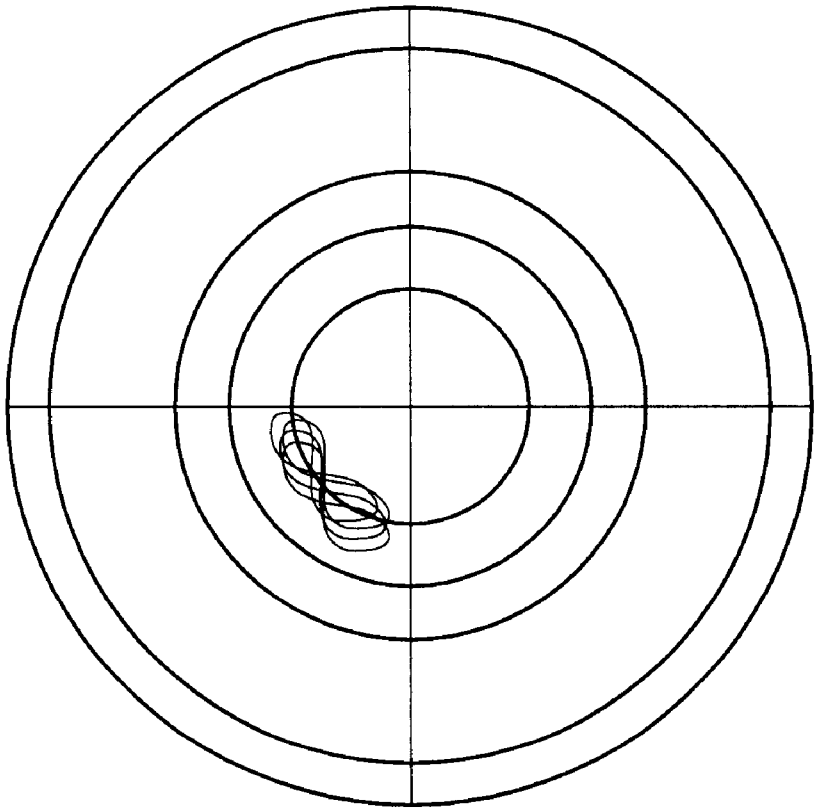
FIG. 3 (PRIOR ART)
FIG. 3 is a Rieke chart showing a distribution of impedance characteristics of a conventional microwave oven measured under a standard load.

Reference will now be made in detail to the present preferred embodiments of the present invention, examples of which are illustrated in the accompanying drawings, wherein like reference numerals refer to like elements throughout.

Figure 5:
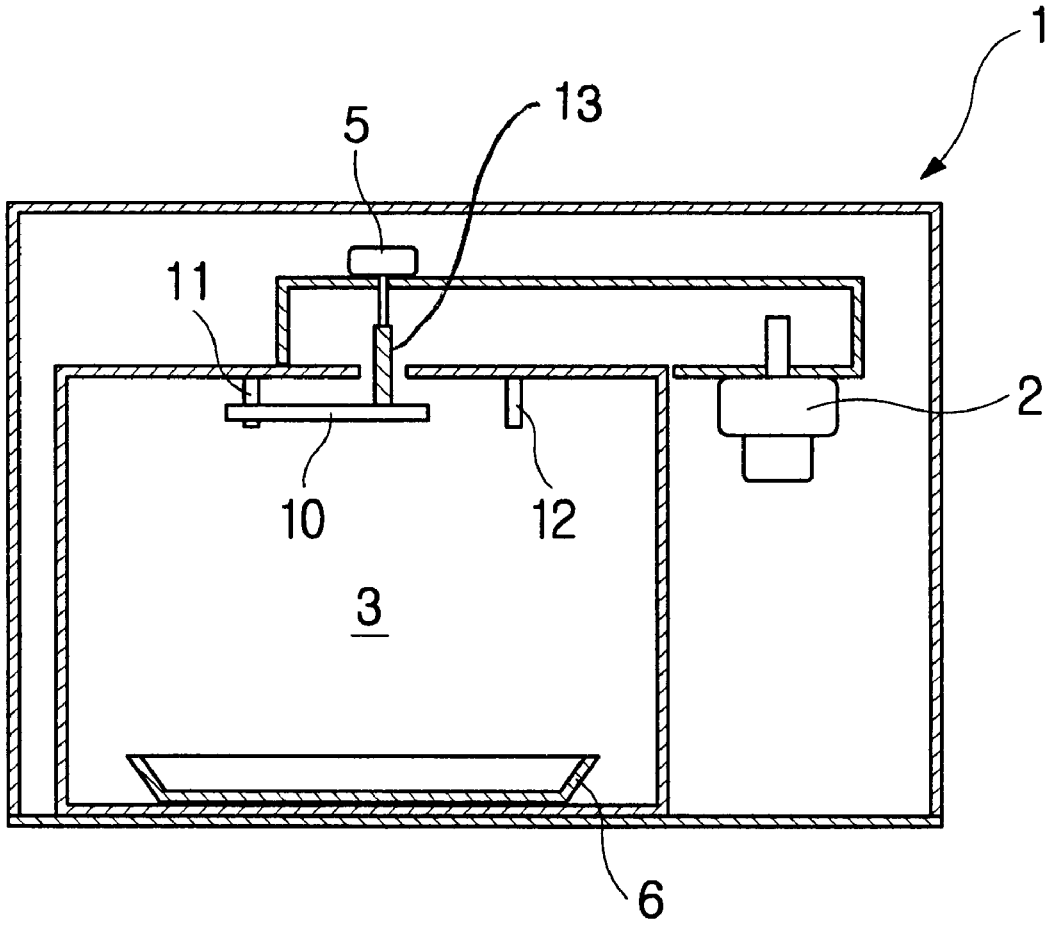
FIG. 5 is a sectional view of a microwave oven having a wave distributing device in accordance with an embodiment of the present invention.

FIG. 5 shows a sectional view of a microwave oven having a wave distributing device in accordance with an embodiment of the present invention. The wave distributing device comprises a rotor 10 which is installed at a top portion of a cooking cavity 3 of an oven body 1 and is operated by a motor 5. The wave distributing device further comprises a rotation trace limiter which limits a rotation trace range of the rotor 10.

The rotation trace limiter comprises stoppers 11 and 12. The rotor 10 comprises one of a metal stirrer fan and an antenna, and is rotated by the motor 5. Each of the stoppers 11 and 12, for example, has a cylindrical rod shape, and is mounted to a top wall of the cooking cavity 3 at one end thereof and extends downward in a vertical direction. The stoppers 11 and 12 have corresponding positions so as to reciprocate the rotor 10, which is mounted to a rotating shaft 13 of the motor 5, within a predetermined range R2 of a rotation trace as shown by an arrow in FIG. 6.

Figure 6:
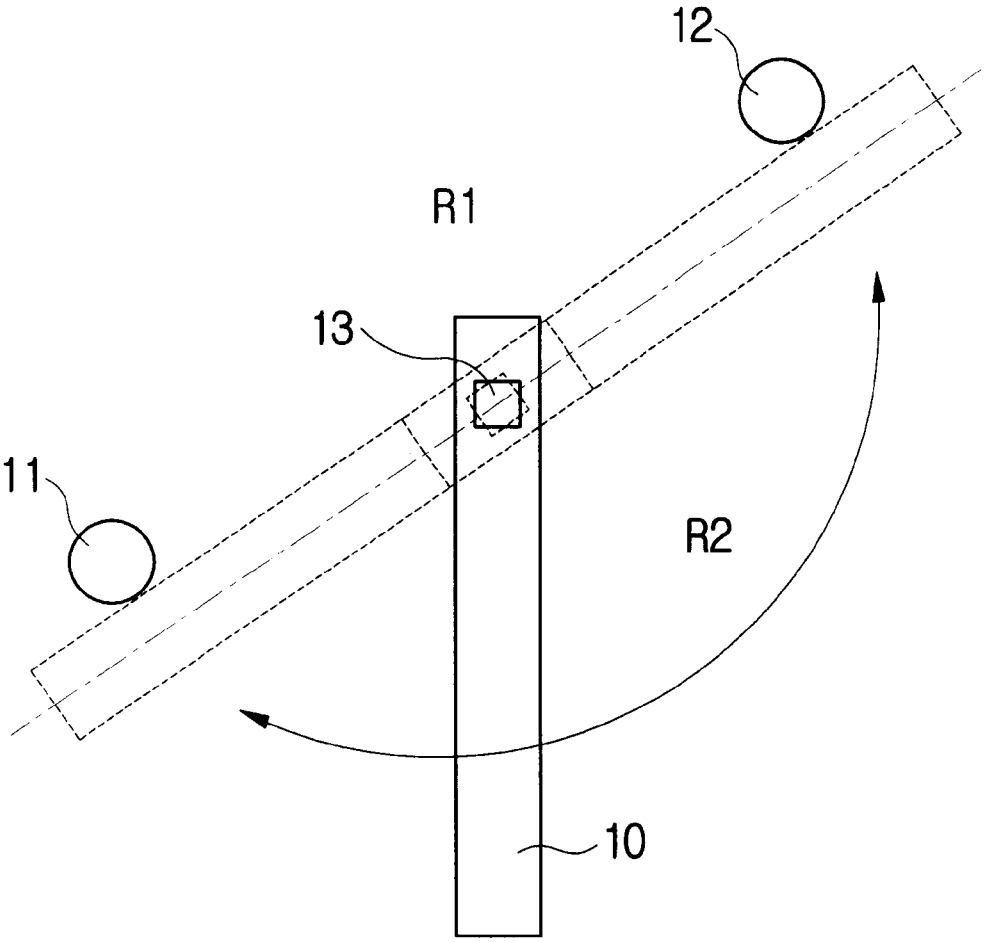
FIG. 6 is a plan view of a portion of the wave distributing device of the microwave oven according to the embodiment shown in FIG. 5.

FIG. 6 illustrates an example of the predetermined range R2 of the rotor which results in a good distribution of the impedance characteristics of the microwave oven. The range R1 of the rotation trace results in a bad distribution of the impedance characteristics of the microwave oven.

As shown in FIG. 5, with reference to FIG. 6, the motor 5 is a reversible motor which is rotated in opposite directions by an alternating current. The motor 5 is started simultaneously with the start of a magnetron 2. During the operation of the microwave oven, the rotor 10 is rotated in, for example, a clockwise direction by the motor 5, and comes into contact with the first stopper 11. Thereafter, the rotor 10 is repelled by the first stopper 11 in a counterclockwise direction. Thus, the motor 5 is rotated in a reverse direction, and rotates the rotor 10 in the counterclockwise direction within the range R2 until the rotor 10 comes into contact with the second stopper 12. As the rotor 10 is brought into contact with the second stopper 12, it is repelled by the second stopper 12, and is rotated toward the first stopper 11. This reversible rotating action of the rotor 10 is repeated during the operation of the motor 5.

A reversible rotating action of the rotor 10 between the two stoppers 11 and 12 may generate an operational noise. To prevent the noise, each of the two stoppers 11 and 12 is covered with an elastic member which dampens the noise.

Figure 9:
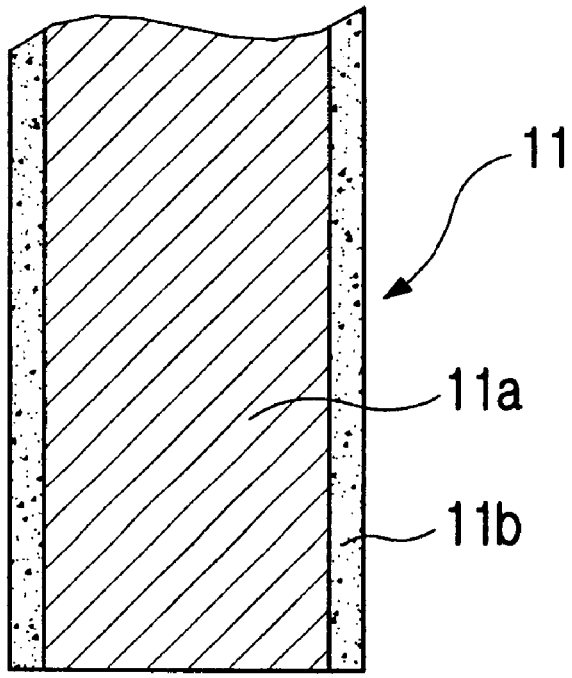
FIG. 9 is a sectional view of a stopper of the wave distributing device according to the embodiment shown in FIG. 5.

FIG. 9 shows, for example, that the stopper 11 is produced by covering a metal core 11*a* with an elastic member 11*b*. The elastic member 11*b* may be a rubber or a resin suitable to handle a repelling force generated by the repeated contact between the rotor 10 and the stopper 11.

Figure 7:
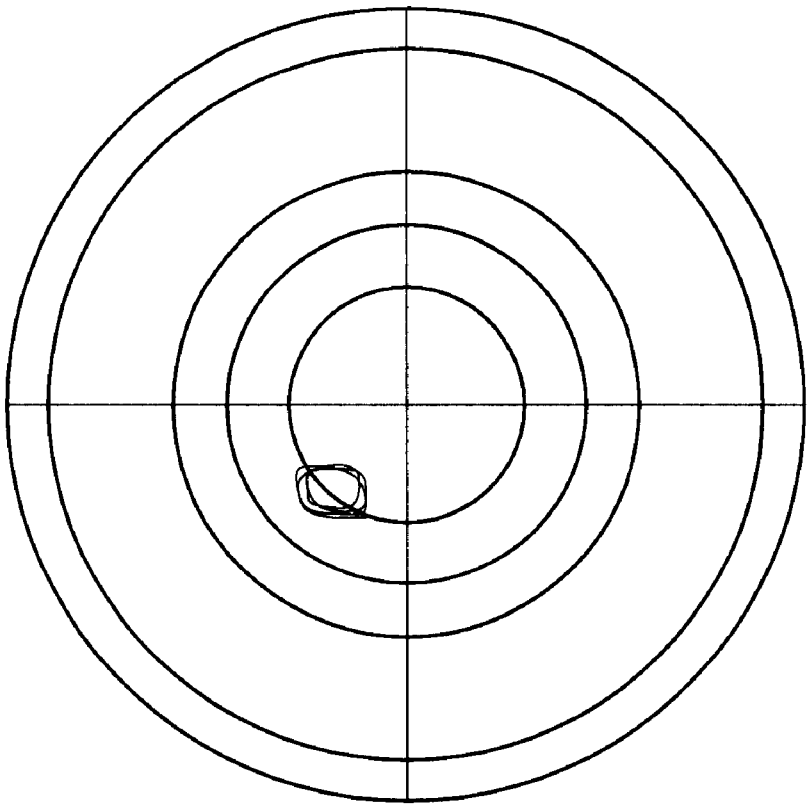
FIG. 7 is a Rieke chart showing a distribution of impedance characteristics of the microwave oven according to the embodiment shown in FIG. 5 under a standard load.

FIG. 7 shows a Rieke chart illustrating a distribution of impedance characteristics of the microwave oven of the present invention measured under a standard load. FIG. 7 shows that the impedance characteristics measured under the standard load are distributed at an area around the center of the Rieke chart, thus revealing that the optimal energy efficiency of the magnetron 2 is achieved.

Figure 4:
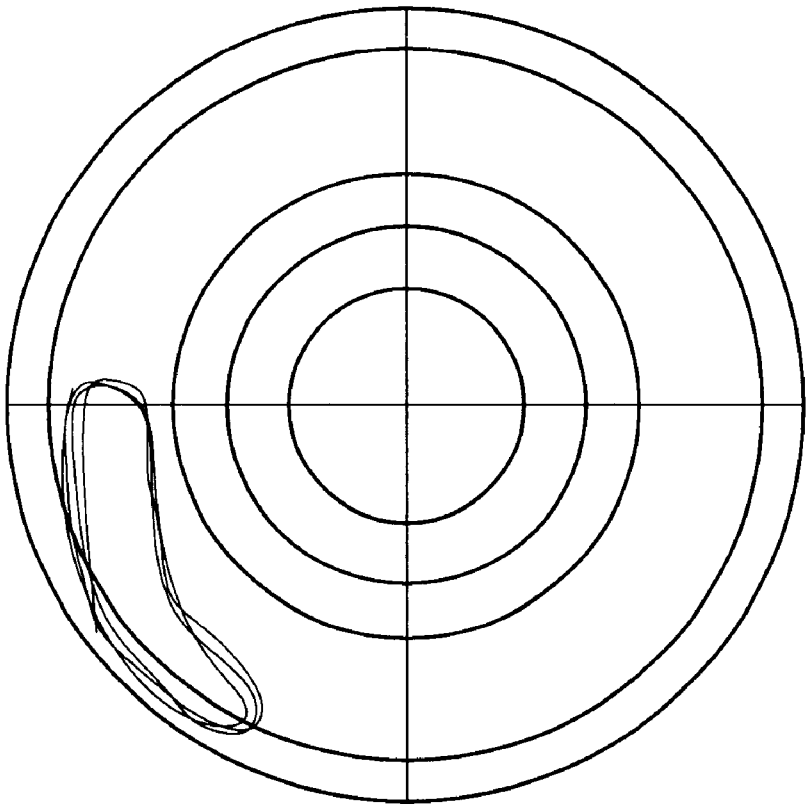
FIG. 4 (PRIOR ART)
FIG. 4 is a Rieke chart showing a distribution of impedance characteristics of a conventional microwave oven measured under a no-load or a light load.
Figure 8:
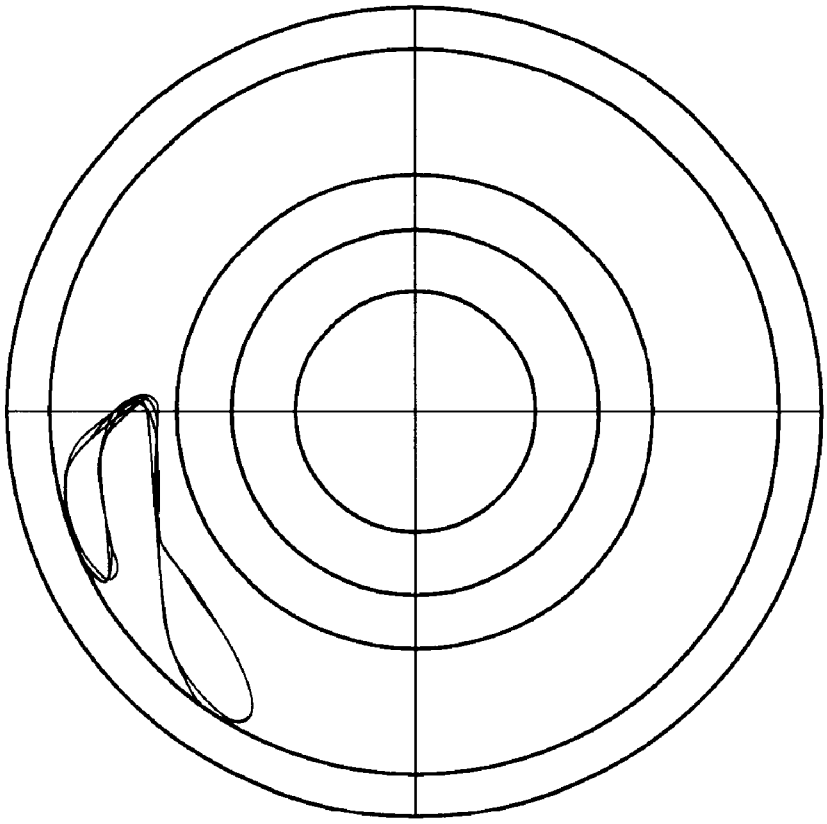
FIG. 8 is a Rieke chart showing a distribution of impedance characteristics of the microwave oven according to the embodiment shown in FIG. 5 measured under a no-load or a light load.

FIG. 8 shows a Rieke chart illustrating a distribution of the impedance characteristics of the microwave oven of the present invention measured under a no-load or a light load. As shown in FIG. 8, the impedance characteristics measured under the no-load or the light load are distributed toward an inner area of the Rieke chart as compared to, the distribution of the impedance characteristics of the conventional microwave ovens shown in FIG. 4.

That is, in the microwave oven of the present invention, the rotation trace range of the rotor of the wave distributing device is limited, so as to prevent the rotor from passing through a range of a rotation trace which provides a bad distribution of the impedance characteristics. Therefore, the microwave oven according to the present invention has a good distribution of the impedance characteristics under a standard load, a no-load or a light load.

Figure 10:
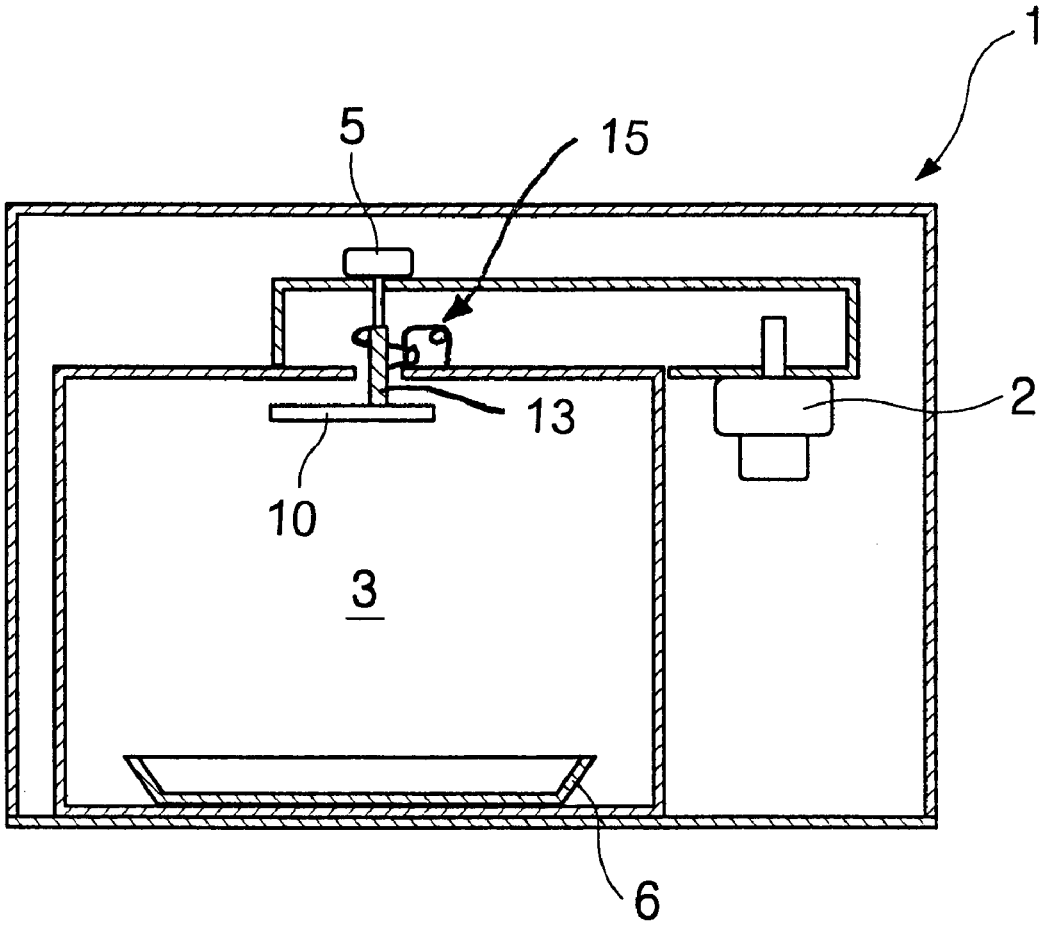
FIG. 10 is a sectional view of a microwave oven having a wave distributing device in accordance with another embodiment of the present invention.

While a rotation trace limiter comprising stoppers has been described, it is understood that the rotation trace limiter may alternatively comprise another mechanism unit without affecting the functioning of the rotation trace limiter. For example, FIG. 10 shows a microwave oven having a cam mechanism unit 15 which changes a movement of a motor shaft 13 that connects a rotor 10 to a motor 5. It is understood that that the cam mechanism unit 15 can be arranged in a cooking cavity 3 or other appropriate locations. It is also understood that instead of the stopper or the cam mechanism unit, the motor of the microwave oven of the present invention may be set to reciprocate the rotor in a predetermined rotation angle (rotation trace range) so as to provide optimal intrinsic impedance characteristics. Alternatively, the motor may reciprocate the rotor in a rotation angle corresponding to a cooking load sensed by the microwave oven of the present invention, so as to optimize energy efficiency of the magnetron.

As described above, the present invention provides a microwave oven having a wave distributing device including a rotor which is limited in its rotation trace to a predetermined range. The wave distributing device is designed so as to provide a good distribution of impedance characteristics of the microwave oven under a variety of loading conditions. Therefore, optimal energy efficiency is achieved, and electrical energy used during an operation of the microwave oven is saved. In addition, the present wave distributing device reduces the amount of microwaves that are reflected back to a magnetron during an operation under a no-load or a light load. Accordingly, the life expectancy of the magnetron is increased and the overall operational reliability of the microwave oven is improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a cooking cavity;

a magnetron which generates high-frequency electromagnetic waves; and a wave distributing unit which distributes the high-frequency electromagnetic waves through the cooking cavity, wherein the wave distributing unit comprises:

a rotor installed inside the cooking cavity and distributes the high-frequency electromagnetic waves through the cooking cavity, a rotation trace limiter which limits a rotation trace range of the rotor, and a motor coupled to the rotor and reversibly rotates the rotor.

2. The microwave oven according to claim 1, wherein the rotation trace limiter comprises a stopper which limits a rotation of the rotor.

3. The microwave oven according to claim 2, wherein the stopper comprises a cylindrical rod, wherein one end of the cylindrical rod is fixed to an area adjacent to the rotor.

4. The microwave oven according to claim 2, wherein the stopper comprises a core member and an elastic member which covers the core member.

5. The microwave oven according to claim 2, further comprising a second stopper which limits the rotation of the rotor.

6. The microwave oven according to claim 2, wherein the stopper limits the rotation trace range of the rotor to improve intrinsic impedance characteristics of the microwave oven.

7. The microwave oven according to claim 1, further comprising a motor shaft connecting the rotor to the motor, wherein the rotation trace limiter comprises a cam mechanism unit which changes a movement of the motor shaft.

8. The microwave oven according to claim 1, wherein the motor comprises a synchronous motor which selectively rotates in a forward direction and a reverse direction in response to an alternating current.

9. The microwave oven according to claim 8, wherein the synchronous motor reciprocates the rotor within the rotation trace range.

10. The microwave oven according to claim 9, wherein:

the rotation trace limiter comprises a stopper which repels the rotor; and the synchronous motor is rotated in the forward direction to rotate the rotor in one direction, and is rotated in the reverse direction to rotate the rotor in the opposite direction in response to a contact between the rotor rotated in the one direction with the stopper.

11. A microwave oven comprising:

a cooking cavity;

a magnetron which generates high-frequency electromagnetic waves; and a wave distributing unit including:

a rotor which is installed inside the cooking cavity and distributes the high-frequency electromagnetic waves through the cooking cavity, and a motor which is coupled to the rotor and reciprocates the rotor in a predetermined rotation angle.

12. The microwave oven according to claim 11, wherein the wave distributing unit further includes a stopper which sets the predetermined rotation angle of the rotor.

13. The microwave oven according to claim 12, wherein the stopper comprises a core member and an elastic member which covers the core member, so as to reduce an operational noise of the microwave oven.

14. The microwave oven according to claim 13, wherein the wave distributing unit further comprises a second stopper which, along with the stopper, sets the predetermined rotation angle of the rotor.

15. The microwave oven according to claim 12, wherein the motor comprises a synchronous motor which selectively rotates in opposite directions in response to one of an alternating current, and a contact between the rotor and the stopper.

16. The microwave oven according to claim 11, wherein the predetermined rotation angle of the rotor is set according to a structure, shape and material of the cooking cavity so as to optimize the intrinsic impedance characteristics of the microwave oven.

17. The microwave oven according to claim 11, wherein the wave distributing unit further includes a cam mechanism unit which changes a movement of a motor shaft that connects the rotor to the motor so as to reciprocate the rotor in the predetermined rotation angle.

18. The microwave oven according to claim 11, wherein the motor comprises a synchronous motor which selectively rotates in opposite directions in response to an alternating current.

19. The microwave oven according to claim 11, wherein the predetermined rotation angle provides optimal intrinsic impedance characteristics of the microwave oven.

20. A microwave oven comprising:

a cooking cavity;

a magnetron which generates high-frequency electromagnetic waves;

a wave distributing unit including a rotor installed inside the cooking cavity and distributes the high-frequency electromagnetic waves through the cooking cavity; and a motor which is coupled to the rotor and reciprocates the rotor in an angle corresponding to a cooking load sensed by the microwave oven.

21. The microwave oven according to claim 20, wherein the angle corresponds to an optimal distribution of intrinsic impedance characteristics of the microwave oven.

22. The microwave oven according to claim 20, wherein the angle optimizes an energy efficiency of the magnetron.

* * * * *